United States Patent [19]

Heyer et al.

[11] 4,236,921

[45] Dec. 2, 1980

[54] HEAT RESISTANT ALLOY CASTINGS

[75] Inventors: Bruce A. Heyer, Mahwah; Donald L. Huth, Ringwood, both of N.J.

[73] Assignee: Abex Corporation, New York, N.Y.

[21] Appl. No.: 16,968

[22] Filed: Mar. 2, 1979

[51] Int. Cl.[3] ..... C22C 19/00

[52] U.S. Cl. ..... 75/134 F; 75/171

[58] Field of Search ..... 75/134 F, 171, 134 N, 75/128 W

[56] References Cited

U.S. PATENT DOCUMENTS 3,127,265 3/1964 Avery ..... 75/171

3,681,059 8/1972 Shaw et al. ..... 75/134 F

FOREIGN PATENT DOCUMENTS 47-18333 5/1972 Japan ..... 75/122

1252218 11/1971 United Kingdom ..... 75/134 F

*Primary Examiner*—L. Dewayne Rutledge

*Assistant Examiner*—Upendra Roy

*Attorney, Agent, or Firm*—Kinzer, Plyer, Dorn & McEachran

[57] ABSTRACT

A heat resistant ferrous metal alloy casting having improved resistance to thermal fatigue and comprising chromium, nickel, cobalt, tungsten and titanium.

1 Claim, No Drawings

HEAT RESISTANT ALLOY CASTINGS

This invention relates to an improvement in a known heat resistant alloy for castings and in particular to an improvement in the thermal fatigue property.

The known alloy is disclosed in U.S. Pat. No. 3,127,265, characterized by:

Carbon, 0.3/0.95
Silicon, 0.5/2
Nickel, 26/42
chromium, 22/32
Cobalt, 9/26
Tungsten, 3/16
Balance essentially Iron.

The known alloy has a austenite matrix supersaturated with carbon and inherently undergoes precipitation strengthening during aging at elevated temperature; the desirable mechanical properties are inherent in the as-cast form, requiring neither heat treatment nor working for the best property. These features are also true of the present alloy.

In the known alloy, improved by the present invention, nickel (26/42) contributes to oxidation resistance, is essential for stabilizing the austenite and contributes to creep rupture strength, and resistance to thermal fatigue. Chromium (22/32) is the principal source of resistance to oxidation and is the principal carbide former for precipitation strengthening. Carbon is necessary for carbide formation and strengthening but must be carefully controlled at the upper limit so that ductility is not drastically impaired. Tungsten contributes both to solid solution strengthening and carbide stability. These alloy features are necessary to a casting having good thermal fatigue resistance and stress rupture properties when in service at elavated temperatures.

Castings at high temperature are often under repeated thermal cycling, hot at one time, soon considerably cooler and then back up to the upper service temperature. The casting is thereby stressed, which can shorten the life of the casting. For this reason, resistance to thermal fatigue is an important property for some industrial applications.

The resistance of an alloy casting to thermal fatigue can be determined by cycling the test casting between extreme temperatures within a given time span, using the same test cycle for each casting. The cycles presented in the table immediately following were between the extremes of 300° F. and 1800° F. (hold three minutes at each temperature and then go to the other within a given time span). Resistance to thermal fatigue can be visibly observed in terms of crack propagation, purposely induced by a severe test.

TABLE I

| HEAT | CHEMICAL COMPOSITION C % | Mn % | Si % | Cr % | Ni % | Co % | W % | Ti % | N % | Ni&Co % | First Crack (Cycles) | No. Cracks At 700 Cycles | Max.Crack Lgth At 700 Cycles(in.) |
|---|---|---|---|---|---|---|---|---|---|---|---|---|---|
| 23(AA) | .44 | .60 | 1.17 | 25.5 | 53.2 | .05 | 5.10 | .38 | .123 | 53.2 | 150 | 15 | .37 |
| 20(AB) | .40 | .71 | 1.15 | 24.9 | 35.0 | .09 | .54 | .30 | .154 | 35.1 | 250 | 13 | .27 |
| -4(AC) | .42 | .70 | 1.28 | 25.6 | 35.8 | .09 | .12 | .00 | .144 | 35.9 | 250 | 3 | .36 |
| -4(AD) | .45 | .60 | 1.15 | 26.0 | 53.5 | .05 | 5.00 | .04 | .118 | 53.6 | 400 | 1 | .37 |
| *-4(AE) | .47 | .59 | 1.22 | 26.2 | 36.3 | 15.4 | 4.66 | .00 | .144 | 51.7 | 600 | 2 | .37 |
| -4(AF) | .53 | .93 | 1.26 | 23.0 | 31.8 | 14.6 | 2.25 | .57 | .058 | 46.4 | 400 | 6 | .24 |
| **-4(AG) | .41 | .96 | 1.32 | 23.7 | 21.5 | 15.6 | 2.23 | .53 | .054 | 37.1 | 400 | 3 | .15 |
| ***-4(AH) | .45 | .89 | 1.13 | 21.6 | 29.2 | 15.4 | 5.17 | .37 | .037 | 44.6 | 400 | 2 | .19 |
| -19(AK) | .47 | .58 | 1.13 | 25.8 | 36.3 | 15.1 | 4.63 | .31 | .180 | 51.4 | 400 | 1 | .03 |
| -4(AL) | .45 | 1.00 | 1.19 | 24.6 | 35.3 | 14.8 | 5.16 | .34 | .032 | 50.1 | 600 | 3 | .02 |
| -4(AN) | .45 | .49 | 1.07 | 25.0 | 35.3 | 15.2 | 4.76 | .35 | .067 | 50.5 | 850 | 0 | 0 |

* U. S Patent No. 3127265 (1964)

** British Patent 1252218 (1971)

*** British Patent No. 1252218 (1971) - Modified with W > 3%

Heats AA and AB (no cobalt) exhibited the least resistance to thermal fatique, though heat AA contained both tungsten and titanium.

When cobalt is added to the alloy along with more than 4% (all weight %) tungsten, there is a considerable increase in resistance to thermal fatigue as evidenced by comparing heat AC with heat AE, verifying the assertions in U.S. Pat. No. 3,127,265.

The alloy of heats AK, AL and AM differs essentially from heat AE in the addition of a small amount of titanium (say 0.3/0.35). While one crack was observed after 400 cycles in the test casting of heat AK, compared to 600 cycles for heat AE, growth of the crack was only 0.03" at 700 cycles compared to a crack of more than ten times that length which occurred in the heat AE casting. The superiority of heats AL and AN to heat AE is readily perceived in terms of the addition of a small but effective amount of titanium.

It has been asserted by others that in an alloy of the general kind involved (e.g., heat AH) that if more than three percent tungsten is employed (in the presence of a small amount of titanium) the results are not beneficial: the austenite matrix becomes unstable, the ductility goes down and the alloy becomes expensive. Matrix instability and loss of ductility mean structural instability. Clearly, we have not experienced those difficulties when employing more than three percent tungsten, and yet we do not employ any technique for preparing the melt, tapping the heat, and pouring the casting different from standard practice for the kind of heat resistant alloy and casting represented by the present practice.

To the contrary, the thermal fatigue test can be related to structural instability and clearly our alloys are not unstable. Heat AL in particular shows no loss in austenite stability as indicated by thermal fatigue results at least equal to those of heat AG. For the results achieved the amount of tungsten in excess of three percent represents minimal cost.

Heats AF and AL may be compared to observe the advantage of coupling a small amount of titanium to an amount of tungsten well above three percent. Even when the nickel is lowered (cobalt substantially constant) the resistance to fatigue failure is improved by coupling a small amount of titanium to an amount of tungsten of more than five percent; compare heat AG to heat AL.

It is to be stressed that we are necessarily concerned with the property of thermal fatigue resistance in the cobalt-containing alloy. If the concern is with a cobalt-free alloy having superior creep rupture strength one would opt for the alloy of our U.S. Pat. No. 4,077,801.

Based on heats AK, AL and AM, our previous experience with this kind of alloy (as represented by practice under U.S. Pat. No. 3,127,265 for example) and our previous experience with the alloy of U.S. Pat. No. 4,077,801, our preferred alloy casting is:

Carbon 0.3/0.8
Silicon 3.5 max.
Manganese 1.25 max.
Nickel 26/42
Chromium 22/32
Cobalt 9/26
Tungsten 3.5/7.5
Titanium 0.3/0.35 balance substantially all all iron with molybdenum 0.5 max. and nitrogen not more than 0.3.

The ranges set forth above are preferred for standard foundry practice applied to a sand casting. The amounts may vary to permit leeway for the foundry superintendent.

A typical casting in which the invention may be embodied is a riser tube which may be subjected to severe thermal cycling.

Nominally, and by that we mean the most preferred practice for the foundry superintendent, the analysis is:

Carbon 0.45
Silicon 3.5 max.
Manganese 1.25 max.
Chromium 25
Nickel 35
Cobalt 15
Tungsten 4.5
Titanium 0.3
Balance substantially all iron

We claim:

1. A casting of heat resistant alloy having improved resistance to thermal fatigue and consisting essentially of:

Carbon 0.45
Manganese 1.25 max.
Silicon 3.5 max.
Chromium 25
Nickel 35
Cobalt 15
Tungsten 4.5
Titanium 0.35
Iron Balance, substantially.

* * * * *